United States Patent [19]

Oda et al.

[11] 3,950,165

[45] Apr. 13, 1976

[54] METHOD OF LIQUID-PHASE SINTERING FERROUS MATERIAL WITH IRON-TITANIUM ALLOYS

[75] Inventors: Teishiro Oda; Takashi Daikoku, both of Nagasaki, Japan

[73] Assignee: Mitsubishi Jukogyo Kabushiki Kaisha, Japan

[22] Filed: Sept. 6, 1973

[21] Appl. No.: 394,630

Related U.S. Application Data

[63] Continuation-in-part of Ser. No. 205,614, Dec. 7, 1971, which is a continuation-in-part of Ser. No. 171,394, Aug. 12, 1971, which is a continuation-in-part of Ser. No. 751,074, Aug. 8, 1968, abandoned.

[30] Foreign Application Priority Data

Aug. 9, 1967 Japan ..... 42-51068
Nov. 18, 1967 Japan ..... 42-74100

[52] U.S. Cl. ..... 75/200; 75/226; 75/208 R; 29/182.1

[51] Int. Cl.[2] ..... B22F 3/00; B22F 1/00

[58] Field of Search ..... 75/200, 214, 208, 226; 29/182.1

[56] References Cited

UNITED STATES PATENTS 1,775,358 9/1930 Smith ..... 75/226
2,254,549 9/1941 Small ..... 75/200

FOREIGN PATENTS OR APPLICATIONS 599,259 7/1960 Canada
1,225,869 4/1967 Germany

*Primary Examiner*—Benjamin R. Padgett
*Assistant Examiner*—B. Hunt
*Attorney, Agent, or Firm*—McGlew and Tuttle

[57] ABSTRACT

A method of sintering ferrous materials comprises mixing an iron powder with an alloy of iron-titanium and forming a liquid phase during the sintering. The alloy is prepared by mixing selected amounts of iron and titanium powders to form an iron-titanium alloy powder consisting essentially of 14 to 46% by weight of titanium and the balance iron, and preferably 14 to 30% by weight of titanium. The sintering step is carried out at a temperature at which the powdered mixture is always in the liquid phase during sintering. Under these conditions oxidation of titanium is suppressed during melting and the alloy is not too soft nor too difficult to pulverize and used for manufacturing the machine components such as piston rings which have surprisingly good properties due to the use of the critical amounts of iron and titanium in the alloys useful according to the invention.

2 Claims, 2 Drawing Figures

INVENTORS
TEISHIRO ODA
TAKASHI DAIKOKU
BY John J. McGlew
ATTORNEY

METHOD OF LIQUID-PHASE SINTERING FERROUS MATERIAL WITH IRON-TITANIUM ALLOYS

CROSS-REFERENCE TO RELATED APPLICATIONS

This application is a continuation-in-part of copending application Ser. No. 205,614, filed Dec. 7, 1971, which is in turn a continuation-in-part of copending application Ser. No. 171,394, filed on Aug. 12, 1971, which is itself in turn a continuation-in-part of copending application Ser. No. 751,074 filed on Aug. 8, 1968, now abandoned.

BACKGROUND OF THE INVENTION

1. Field of the Invention

Recently, sintered ferrous materials have found wide application as structural components in machines. However, such materials are rarely used as the main structural components of machines. The failure to use sintered materials as main structural components stems from the porous character of such components which are inferior in mechanical properties to casting or forged materials having the same composition. To promote the use of sintered materials in such components, various efforts have been made to increase the density of the sintered material up to a value close to the theoretical density. The present invention employs a specially selected iron-titanium alloy in a liquid phase sintering method which produces excellent machine components.

2. Description of the Prior Art

In one attempt to decrease the porosity of sintered material and to increase its density, the pressure employed in compressing the powders has been increased. In one instance, the density of a green compact obtained under a compacting pressure of 4 ton/cm$^2$ was about 78 percent of the solid iron metal, and by increasing the pressure to 8 ton/cm$^2$, the density increased to about 90 percent of the solid iron metal. Though a higher density was achieved by increasing the compacting pressure, the wear of the metal dies was accelerated and this, in turn, had an adverse effect on the economics of the operation. Accordingly, the pressure employed in compacting operations of powders is, for practical purposes, limited to between 4 to 6 ton/cm$^2$, at the most, and in such instances, the density of the green compacts formed is usually on the order of 6.0–6.6 g/cm$^3$. When such compacts are sintered, the progress of sintering is very slow, because of the solid phase sintering and, as a result, little shrinkage is obtained, and it is very difficult to achieve a denser sintered material.

In other efforts to obtain a more dense sintered product the following processes have been employed: (1) a method employing repeated compressing and sintering steps, (2) a liquid phase sintering method, and (3) an infiltration method, however, each of these processes has disadvantages which render its use impractical.

1. In the method employing repeated compressing and sintering steps, the considerable number of separate operations required to obtain a suitably high density material has made this process very expensive.

2. In the liquid phase sintering method elements, such as phosphorus, boron, copper and others, have been included with the iron to form a liquid phase at the sintering temperature and, as the amount of the element is increased, the degree of sintering is improved and the final product becomes more dense. However, when more than 0.8% by weight of phosphorus and/or more than 0.2% by weight of boron are used, the product obtained is very brittle because hard eutectic phases remain at the grain boundaries. Furtherm if copper is added, the ductility of the sintered product is adversely affected due to the intrinsic properties of the copper. As a result, in the past where liquid phase sintering methods have been used, the sintered products achieved have been very brittle.

3. In the infiltration method, the pores of the sintered solid are filled with copper in the fused state by a capillary phenomenon and, as a result, the density of the sintered material is increased. However, as indicated above, the difficulty of sintered materials containing an addition of copper is adversely affected.

The Canadian Pat. No. 599,259 teaches a method of making porous metal piston rings of nickel-titanium alloy. These components of machines are relatively porous and not suitable for the purposes of the present invention which yields a structural component of higher density and strength than that of Canadian Pat. No. 599,259 which is a forged product formed of a hard nickel-titanium-iron ternary alloy wherein there is some fusion of nickel-titanium alloy at higher sintering temperatures. The present invention permits formation of a machine component of high density, and low porosity without the necessity of a forging step by selection of critical amounts of titanium-iron alloy components and carrying out sintering completely in the liquid phase.

SUMMARY OF THE INVENTION

The primary object of the present invention is to overcome the disadvantages of the sintering processes mentioned above and to produce a sintered material having a higher density and strength compared to that previously attainable according to Canadian Pat. No. 599,259 and other prior art references. It is also a principal object of the invention to provide machine components by the new sintering method of the invention, especially exhaust valve seats for internal combustion engines composed of critical amounts of titanium-iron alloy by completely liquid phase sintering.

Another object of the invention is to utilize an alloy powder of titanium mixed with the iron powder containing a material which affords a liquid phase at the sintering temperatures employed.

Still another object of the invention is to utilize critical amounts of an iron-titanium alloy powder to establish a liquid phase during the sintering operation whereby the density and strength of the end product is surprisingly and considerably improved.

In addition, the present invention concerns a method of sintering ferrous materials in which an iron-titanium alloy powder, consisting of from about 14 to about 46% by weight, preferably 14 to 30% by weight of titanium, and the balance iron, is mixed in the ratio of 0.1 to 8% by weight of titanium with an iron powder. When the resultant powder mixture is heated to the temperature required for the sintering operation, a liquid phase is established.

As compared to the prior art, where phosphorus, boron and copper were utilized for the purpose of yielding a liquid phase during the sintering operation, by substituting an iron-titanium alloy consisting of 14 to 46% by weight of titanium and the balance iron, it is possible to establish a liquid phase during the sintering operation and to improve the strength of the sintering material without any adverse effect on ductility. Moreover, due to the large solubility of titanium into iron, up to 8% by weight of titanium in the case of an iron-titanium alloy can be effectively mixed with iron powder.

Therefore, as distinguished from the prior art methods, in the method of the present invention, a considerably greater amount of the concerned alloy powders can be added to the iron powder, and, as a result, sintering characteristics of the ferrous material can be sufficiently improved. In accordance with the present invention, sintering characteristicz of ferrous material are improved due to the use of liquid phase sintering; further, with the present invention, the matrix phase is strengthened by use of titanium. These effects being combined, the end product has a higher density and higher strength than that previously attained in prior art methods.

DETAILED DESCRIPTION OF THE PREFERRED EMBODIMENTS

Figure 1:
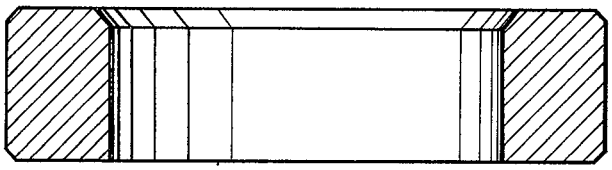

In an iron-titanium alloy, if the alloy contains less than 14% by weight of titanium, it is too soft and is difficult to be pulverized. This is not suitable for ferrous machine components. On the other hand, above 30% by weight of the alloy, especially above 46% by weight of the iron-titanium alloy, it is difficult to suppress oxidation of titanium in melting. The following examples are illustrative of the invention.

Where an iron-titanium alloy is mixed with iron powder in a sintering operation, where the range of titanium in the alloy falls within the preferred 14 to 46% by weight, the liquid phase is formed at temperatures over 1340°C. If sintering is performed at about 1400°C, the liquid phase sintering can be achieved and, as a result, a sintered product having a high density and strength is obtained due to the acceleration of the sintering and the adequate diffusion and dissolution of titanium into the matrix phase because of considerably high temperature sintering.

Where the iron-titanium alloy is used, the preferred amount of titanium mixed with the iron powder is in the range of about 0.1 to 8.0% by weight. If the addition is less than about 0.1% by weight of titanium, the end product is less effective and where there is an addition of more than about 8.0% by weight of titanium intermetallic compounds are formed at the grain boundaries which tend to adversely affect the ductility of the sintered product.

EXAMPLE I

In Table I, there are set forth properties obtained with the addition of iron-titanium alloy to the iron powder. The table indicates the various properties of the sintered irons with the addition of iron-titanium alloy compared with that of a sintered product obtained in a conventional manner. The results, as indicated from Table I, show that by means of the present invention, the sintered irons with higher densities and strengths are attainable than by the conventional sintering method, even though a lower compressing pressure is utilized. The amount of Fe-Ti alloy added to the iron powder is expressed in weight percent titanium based upon the weight of iron powder. The sintering is carried out in Example I at 1400°C for 5 hours.

In the Example I described in Table I below, the Fe-Ti alloy employed to yield a mixture with iron powder having the indicated weight percentages of titanium is as follows:

| | | |
|---|---|---|
| weight percent titanium in Fe-Ti alloy | = | 24.3% |
| weight percent iron in Fe-Ti alloy | = | 75.7% |
| Total weight percent | | 100 % |

In addition to the Fe-Ti alloy above described composition whose results are specified in Table I, other Fe-Ti alloy compositions (in weight percent) are usefully employed as follows, under the same conditions as in Table II:

14% Ti, balance Fe; 20% Ti, balance Fe; 30% Ti, balance Fe; 35% Ti, balance Fe; 46% Ti, balance Fe.

TABLE I

| | (Added) amount of the Fe-Ti alloy (Ti%) | (Compacting) pressure (ton/cm²) | Density of sintered material (g/cm³) | 0.2% proof stress (kg/mm²) | Tensile strength (kg/mm²) | Elongation (%) |
|---|---|---|---|---|---|---|
| The method of the present invention | 0.1 | 5 | 7.40 | 17.6 | 25.9 | 24.8 |
| do. | 1 | 5 | 7.65 | 19.9 | 32.7 | 30.2 |
| do. | 3 | 5 | 7.75 | 22.7 | 38.2 | 29.8 |
| do. | 5 | 5 | 7.72 | 22.4 | 38.0 | 28.4 |
| do. | 8 | 5 | 7.60 | 21.3 | 36.1 | 27.4 |
| A conventional method | — | 8 | 7.14 | 9.8 | 22.3 | 20.8 |

Condition of sintering: 1,400°C × 5 hrs.

In the iron-titanium alloy powder added to the iron powder, such powders may contain impurities, such as carbon, phosphorus, sulphur, manganese and others, up to 1% by weight of the total.

In view of the comparison in Table I of the sintered products obtained using the present invention with those achieved in a conventional sintered method, it can be readily appreciated that sintered ferrous materials having higher densities and higher strengths can be formed using the present invention and these improved characteristics can be easily achieved though a lower compressing pressure is utilized. Accordingly, employing the present invention, sintered ferrous powder can be formed which is very useful in industry. Moreover, the method of the present invention is economically more advantageous because the life of the die used for the compaction or powder will be prolonged since a lower compressing pressure is utilized and there is no necessity for repeated compressing steps in the sintering operation.

EXAMPLE II

Figure 2:
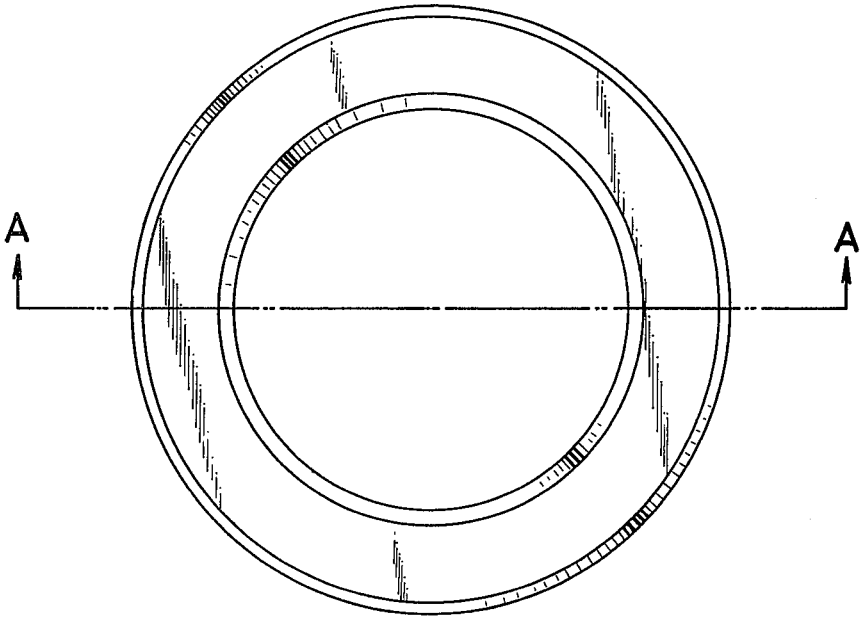

The invention is better understood with reference to the drawing; FIG. 1 shows a sectional view of a valve seat of an exhaust valve for internal combustion engine. The sectional view of FIG. 1 is taken on the line A—A of the top plan view in FIG. 2 of the same exhaust valve seat. This type of exhaust valve seat is manufactured of iron-titanium alloys made according to the process described in Example I.

Further, other similar machine components are usefully produced by these processes, in addition to valve seats.

What is claimed is:

1. A method of sintering ferrous structural material which comprises 1. adding a predetermined quantity of alloy powder consisting essentially of iron-titanium alloy powder composed of about 14 to about 46% by weight of titanium and the balance iron, to an iron powder, wherein the alloy powder added to the iron powder contains impurities comprising up to 1 of the total weight of the alloy powder,
2. cold-pressing the resultant mixture at a pressure of about 5 tons/cm$^2$ and,
3. sintering the resultant powdered mixture in the liquid phase at and above a temperature of about 1400°C at which the iron titanium are fusing, said predetermined amount being in the range of 0.1 to 8% by weight of titanium to iron powder, whereby said ferrous structural material is obtained having density of substantially more than 7 gm/cm$^3$, tensile strength substantially more than 25 kg/mm$^2$, percent elongation more than 25.

2. Method of manufacturing a machine component consisting of an exhaust valve seat of ferrous material having density of substantially more than 7 gm/cm$^3$, tensile strength substantially more than 25 kg/mm$^2$, percent elongation substantially more than 25, which comprises 1. adding to an iron powder a predetermined amount of alloy powder consisting essentially of an iron-titanium alloy powder composed of about 14 to about 46% by weight of titanium, balance iron, said predetermined amount of alloy powder being in the range 0.1 to 8% by weight titanium to iron powder, wherein the alloy powder added to the iron powder contains impurities comprising up to 1 percent of the total weight of the alloy powder;
2. cold-pressing the resultant ferrous alloy powder mixture at a pressure of 5 tons/cm$^2$ into the desired machine component shape,
3. sintering the cold-pressed powdered mixture at a temperature of about 1400°C, and
4. recovering the finished machine component of said ferrous material.

* * * * *